United States Patent [19]

McCoy

[11] Patent Number: 4,541,749

[45] Date of Patent: Sep. 17, 1985

[54] PAPER TRAY AND FOLDER

[76] Inventor: John B. McCoy, 3521 Split Rail La., Ellicott City, Md. 21043

[21] Appl. No.: 605,200

[22] Filed: Apr. 30, 1984

[51] Int. Cl.[4] ..... B41J 11/26

[52] U.S. Cl. ..... 400/613.2; 226/199

[58] Field of Search ..... 400/613.2, 646, 647, 400/647.1; 271/186, 306; 226/196, 199; 270/39

[56] References Cited

U.S. PATENT DOCUMENTS

| | | | |
|---|---|---|---|
| 1,784,873 | 12/1930 | Haywood | 400/646 |
| 2,906,527 | 9/1959 | Blain | 226/199 |
| 3,087,015 | 3/1963 | Stickel | 40/613.2 X |
| 3,134,474 | 5/1964 | Marchman | 400/613.2 |
| 3,575,331 | 4/1971 | Middleman | 226/199 |
| 3,966,194 | 6/1976 | Abbe et al. | 271/186 |

OTHER PUBLICATIONS

"Fanfold Paper Former" *IBM Tech. Discl. Bulletin,* vol. 23, No. 11, Apr. 1981, p. 5260.

*Primary Examiner*—E. H. Eickholt
*Attorney, Agent, or Firm*—John F. McClellan, Sr.

[57] ABSTRACT

A curved-end guide receives traction-feed paper, emerging from a printer or the like, through a slot adjacent the curved-end and re-folds and on a table portion re-stacks the paper in minimum space, with minimum complexity and cost, without delay, without any moving parts and without need to modify the printer, which it stands over on snap-in-place legs that quickly adapt it to fit most customary printers.

4 Claims, 8 Drawing Figures

PAPER TRAY AND FOLDER

FIELD OF THE INVENTION

This invention relates generally to paper handling systems and particularly to a paper tray and paper re-folding system for use with dot matrix printers and typical traction feed pre-folded paper.

SUMMARY OF THE INVENTION

Among important objects of the invention are to provide an efficient, minimum cost system that receives traction feed paper emerging from a printer (or the like type apparatus) at an upward angle through a slot adjacent an upwardly curved end of a portion of the system that re-directs the paper in a reverse direction rolled over on itself and refolds and stacks it.

Further objects are to provide a system as described that requires no moving parts, that can rest on or stand over a printer, in adjusted relation to it without need for modification of the printer, that can operate upwardly, that weighs very little and that can be fashioned largely from a single sheet of thermoplastic.

DETAILED DESCRIPTION

Figure 1:
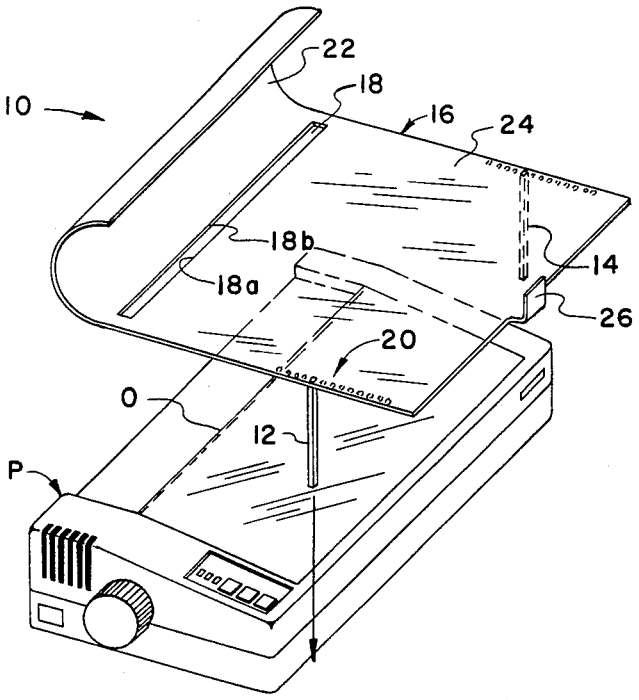
FIG. 1 is a perspective view of a first, preferred embodiment being set down for use with a typical dot matrix printer.

FIG. 1 shows the invention in embodiment 10, a paper tray/folder, being installed (arrow) for use with a typical or representative dot matrix printer P. The paper tray/folder of this embodiment preferably comprises merely: one or more legs, 12, 14, and a platform 16. The legs may be provided with transverse grooves for snap-off length adjustment, or because they are cheap, various-length sets may be provided.

Installation may comprise simply resting the front of the platform 16 on the legs 12 and 14, preferably with the legs in contact with the printer P and the rear resting on the printer P, and with paper exit slot 0 of the printer aligned with paper entrance slot 18 of the embodiment 10.

Alignment of these transverse slots 0 and 18 is easily done by selecting the appropriate holes in the respective series 20 of holes along the lower outboard underside margins, in which to mount the legs by friction fit so that they project downwardly. One central leg is similar, appropriate hole structure along the centerline could serve the purpose.

The platform 16 has respective rear and portions serving co-acting functions in paper re-folding and stacking.

The slot has a front edge 18*a* and a rear edge 18*b* parallel with it and both preferably angled from the vertical toward the rear; paper passes upwardly end-on through the slot toward the rear.

The rear portion 22 of the platform 16 serves as means for re-directing the flow of paper in a forward, downwardly angled direction. This portion rises in an arcuate, forwardly concave, preferably substantially 180° curve, beginning tangent to the slot 18 in a rearwardly direction. Diameter of the curve may preferably be in the range of three to four inches (7.5 to 10 cm). For $8\frac{1}{2}$ by 11 inch standard paper increments, distance between slot and stop may be about $11\frac{1}{2}$ inches (29 cm).

A table-like horizontal support portion 24 of the platform extends forwardly from the slot to an upright stop 26 that may be centered on the forward end. The table portion and stop are proportioned for coaction with the arcuate portion 22 to refold, stop and stack paper received from the arcuate portion, on the front of the table portion.

Embodiment 10 may economically have the platform 16 heat-formed of a single sheet of transparent thermoplastic with the slot within the width.

Figure 2:
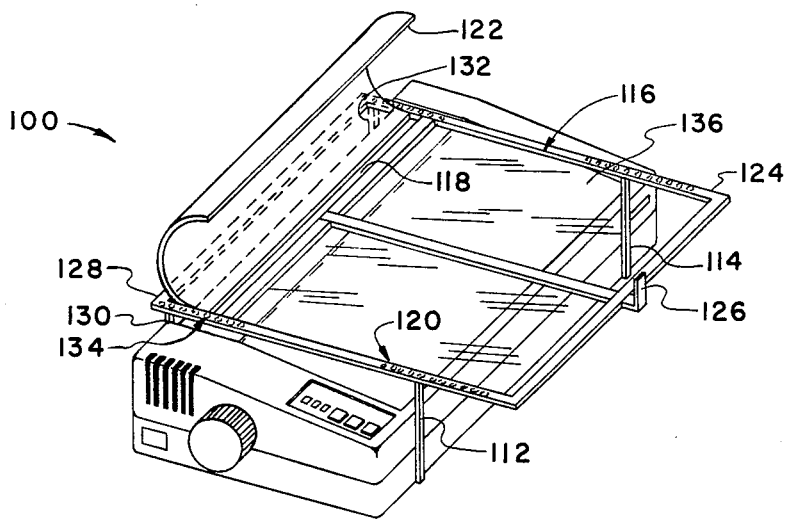
FIG. 2 is a perspective view of a second embodiment in position for use with a typical printer.

FIG. 2 shows with a conventional printer an alternative embodiment 100 with corresponding parts formed of thermoplastic sheet and tubing and cemented together or thermally joined.

Legs 112, 114 may be used ahead of the slot as before, placed in selected holes of a series 120. Platform 116 may be fabricated of tubing; preferably there is a rearward projection 128 past the printer as part of a frame, with a leg or legs 130, 132 similarly mountable in selected holes of a series of holes 134 disposed like those in front but in the rearward projection.

Arcuate portion 122 may be of a sheet of thermoplastic and a sheet of transparent thermoplastic 136 may cover the frame table portion 124 between the slot 118 and the stop 126, giving visual access to the printer below, as with the first embodiment.

Figure 3:
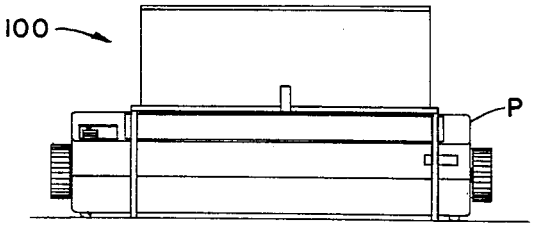
FIG. 3 is a front-end elevational view of the second embodiment in position for use with the printer.
Figure 4:
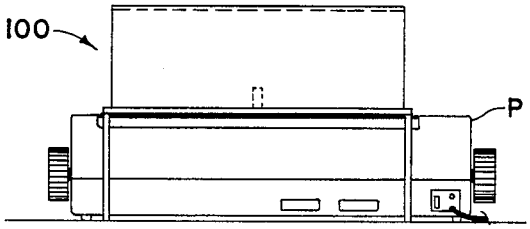
FIG. 4 is a rear-end elevational view of the second embodiment in position for use with the printer.

FIGS. 3 and 4 show respectively the front end view and rear end view of embodiment 100 (embodiment 10 would look similar) on a typical dot matrix printer P.

OPERATION

Figure 5A:
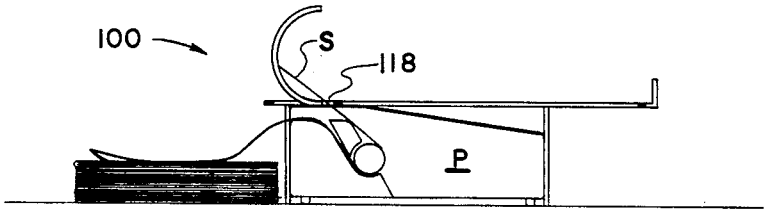
FIGS. 5*a* through 5*d* are side elevational diagrams of the second embodiment in use with the printer, in which the printer is diagrammatically shown.

FIG. 5*a* diagrams embodiment 100 and a printer P in a first stage of operation. Legs, two are shown, hold the slots in adjusted relative position by clasping the length of the printer P.

A typical stack of sheets of paper S, joined in accordian folds, feeds paper through the printer P in the normal manner, in this case the printer is fed from behind. After printing, the serially joined sheets of paper emerge in turn upwardly and to the rear through slot 118.

Figure 5B:
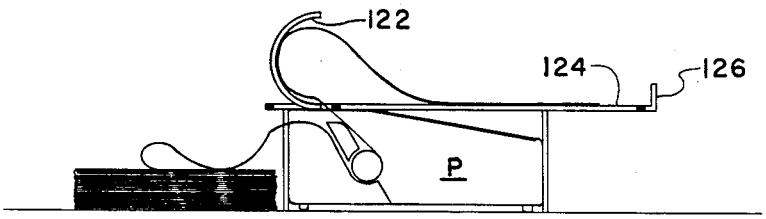

FIG. 5*b* shows that next, arcuate portion 122 receives and redirects the paper forwardly and downwardly in a loop reversing the paper over itself upside-down; the leading edge of the paper slides along the table portion 124, until stopped by upright stop 126.

Figure 5C:
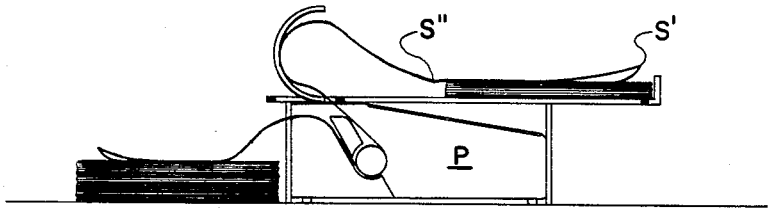
Figure 5D:
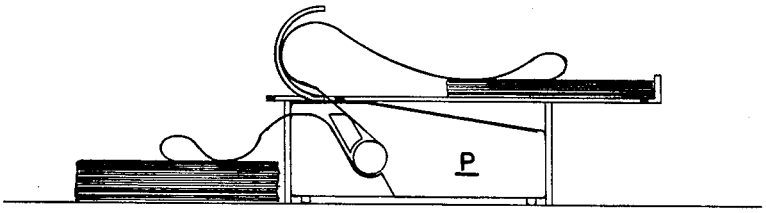

FIGS. 5*c* and 5*d* show at later stages the result of stopping the leading edge, and after it, every succeeding leading fold such as S'. The paper feeds over itself, buckling at the trailing folds S'' and rolling over itself until the leading fold is stopped, and repeating this, re-folding and stacking the paper on the table portion, where it may conveniently be examined, compactly stored, and removed when desired.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by United States Letters Patent is:

1. A system for handling traction-feed paper having successive pre-folds and flowing end-on and unfolded from a location on a printer comprising: structure defining a slot with rearward and forward edges, for receiving said paper in an upwardly angled direction therethrough, means for holding the slot at said location, means for redirecting the flow of said paper in a forward, downwardly angled direction, means for stacking said paper by causing said end of the paper and each prefold in turn to stop, said means for redirecting comprising an arcuate structure extending from adjacent said slot generally rearwardly in said upwardly angled direction and then upwardly and then forwardly, said means for stacking including a support portion for said paper extending forwardly from said slot and an upright member on said support portion, and said support portion and said arcuate structure being respective parts of a unitary sheet of material.

2. A system as recited in claim 1, said unitary sheet of material being transparent.

3. A system for handling traction-feed paper having successive pre-folds and flowing end-on and unfolded from a location on a printer comprising: structure defining a slot with rearward and forward edges, for receiving said paper in an upwardly angled direction therethrough, means for holding the slot at said location, means for redirecting the flow of said paper in a forward, downwardly angled direction, means for stacking said paper by causing said end of the paper and each prefold in turn to stop, said means for redirecting comprising an arcuate structure extending from adjacent said slot generally rearwardly in said upwardly angled direction and then upwardly and then forwardly, said means for stacking including, affixed as a unitary part of the slot defining structure and arcuate structure, a support portion for said paper extending forwardly from said slot and an upright member on said support portion, said means for holding comprising at least one leg projecting downwardly, means for setting the location of said at least one leg for adjustably engaging a said printer, said support portion being locatable over a printer, and said support portion comprising an open framework for providing visibility downward into the printer.

4. A system for handling traction-feed paper having successive pre-folds and flowing end-on and unfolded from a location on a printer comprising: structure defining a slot with rearward and forward edges, for receiving said paper in an upwardly angled direction therethrough, means for holding the slot at said location, means for redirecting the flow of said paper in a forward, downwardly angled direction, means for stacking said paper by causing said end of the paper and each prefold in turn to stop, said means for redirecting comprising an arcuate structure extending from adjacent said slot generally rearwardly in said upwardly angled direction and then upwardly and then forwardly, said means for stacking including a support portion for said paper extending forwardly from said slot and an upright member on said support portion, said means for holding comprising at least one leg projecting downwardly, means including structure defining a plurality of openings in said support portion for setting the location of said at least one leg for adjustably engaging a said printer, said support portion including a rearward projection and said at least one leg being on the rearward projection, said support portion being locatable over a printer, and said support portion comprising an open framework for providing visibility downward into the printer.

* * * * *